United States Patent [19]

Björklund

[11] Patent Number: 4,674,718

[45] Date of Patent: Jun. 23, 1987

[54] METHOD AND APPARATUS FOR KEEPING RAILWAY SWITCHES FREE FROM SNOW

[75] Inventor: Björn Björklund, Västerhaninge, Sweden

[73] Assignee: Fläkt AB, Nacka, Sweden

[21] Appl. No.: 670,542

[22] Filed: Nov. 13, 1984

[30] Foreign Application Priority Data

Nov. 17, 1983 [SE] Sweden ..... 8306346

[51] Int. Cl.[4] ..... E01B 7/24

[52] U.S. Cl. ..... 246/428; 15/301; 104/279

[58] Field of Search ..... 246/428; 104/279, 280; 238/1; 15/301, 316 R; 239/556, 180, 560, 561, 543

[56] References Cited

U.S. PATENT DOCUMENTS

| | | | |
|---|---|---|---|
| 1,778,637 | 10/1930 | Hollinger | 246/428 |
| 2,700,519 | 1/1955 | Gilmore et al. | 246/428 |
| 2,886,266 | 5/1959 | Kistler | 246/428 |
| 2,898,062 | 8/1959 | Magnus | 246/428 |
| 3,312,820 | 4/1967 | Watkins | 246/428 |
| 3,874,298 | 4/1975 | Smith et al. | 104/1 R |
| 3,972,497 | 8/1976 | Ringer | 246/428 |
| 4,081,161 | 3/1978 | Upright | 246/428 |

OTHER PUBLICATIONS

"How to Free Switches of Snow" by R. E. Dave-Sep., 1961, *Railway Signaling & Communications*, pp. 15-16.

*Primary Examiner*—Robert B. Reeves
*Assistant Examiner*—Donald T. Hajec
*Attorney, Agent, or Firm*—Dann, Dorfman, Herrell and Skillman

[57] ABSTRACT

In a method of preventing snow from bedding into railway switches, air is blown into the area between the stock rail and the movable rail in a switch, and substantially horizontally in a direction obliquely outwards towards the open end between the stock rail and the movable rail. An apparatus for carrying out this includes a blower assembly (8) between the rails in a railway switch, the assembly being supplied by a fan unit (20) and adapted to provide a substantially horizontal air discharge directed obliquely outwards towards the open end between the stock rail and the movable rail in their separated positions.

9 Claims, 9 Drawing Figures

METHOD AND APPARATUS FOR KEEPING RAILWAY SWITCHES FREE FROM SNOW

BACKGROUND OF THE INVENTION

If railway switches are to function during winter conditions it is required that they are kept free from snow and ice.

The switches have earlier been kept clear by manual shoveling and sweeping. However, with rising work costs this became an unsatisfactory solution.

Later on electrical heating of sensitive parts of the switch were utilized to melt snow and ice so that the switch could function. This solution has also been found to be burdened with serious weaknesses. The energy consumption makes this solution expensive, and furthermore the melted ice often gives rise to ice water formations which disturb the function of the switch. Finally, due to reasons of economy, the electrical heating can not be dimensioned for particularly cold and snowy periods which nearly always occur at some time or times during each winter. During these periods the electrical heating is insufficient to ensure the function of the switch.

SUMMARY OF THE INVENTION

The present invention relates to a method of, and provides an apparatus for, preventing snow from drifting into railway switches, whereby the disadvantages in the prior art in this respect are avoided.

With a method and an apparatus according to the invention, snow is prevented from drifting into railway switches by falling snow being mechanically blown away with substantially horizontally directed air streams or air curtains. Snow which is whirled up at the passage of a train is also removed in this way from the switch area.

In the method and apparatus in accordance with the invention there is thus no heating, whereby energy is saved and the problems caused by melted ice are eliminated. The method and apparatus furthermore function substantially independently of temperature, i.e. in extreme cold as well.

According to an advantageous embodiment of the invention, air is blown in a direction substantially obliquely outwards towards the open end between the stock rail and the movable rail with the aid of a blower assembly consisting of one or a plurality of blower units. Air is also blown across the entire width of the track with the aid of a blower arrangement disposed on one side of the track. The latter air stream thus effectively removes snow which has been whirled up from the switch area by the first-mentioned air stream.

A plurality of blower units are to advantage coupled to a central supply fan unit, via one or more distribution pipes arranged between, and parallel to the rails. The fan unit is also adapted for supplying the said air blower arrangement.

BRIEF DESCRIPTION OF THE DRAWINGS

To explain the invention in more detail, an embodiment of the apparatus in accordance with the invention is described in the following as an example, and with reference to the accompanying drawings.

DESCRIPTION OF THE PREFERRED EMBODIMENTS

Figure 1:
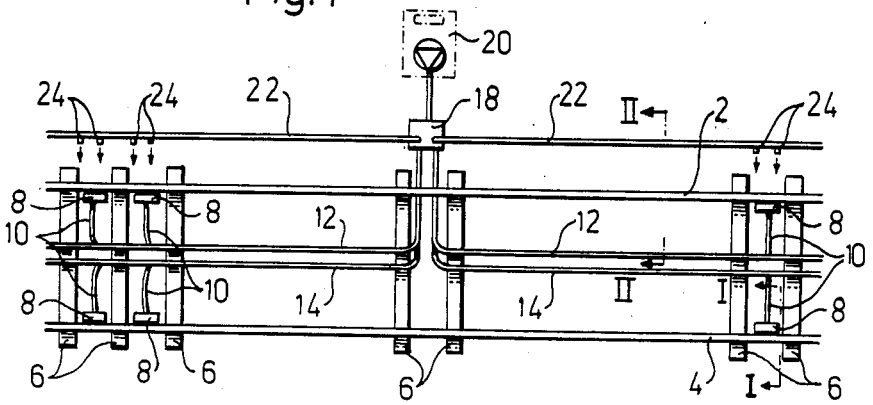
FIG. 1 is a schematic plan view of the switching area of a railway track embodying apparatus in accordance with the present invention, the switch and switch points being omitted in order to simplify the drawing.

A railway track is illustrated in FIG. 1, with rails 2,4 and associated sleepers 6. The part of the track illustrated relates to a switching area, although the switch and switch points are not shown further in order to simplify the figure.

In the switching area there are shown blower assemblies comprising a plurality of blower units 8, arranged on the inside of the rails 2, 4 between the sleepers 6.

The blower units 8 are connected via hoses 10 to distribution pipes 12, 14 extending along the track, and these pipes are connected via supply pipes 16 to a manifold box 18. In turn, the manifold box 18 is connected to a central supply fan unit 20.

A blower arrangement 22 extends along the side of the track, and on either side of the manifold box, to which it is connected.

The blower arrangement has nozzles 24 in the areas where the blower units 8 are placed, and these nozzles are adapted for blowing air transverse the switching area and just above the rails 2, 4.

Figure 2:
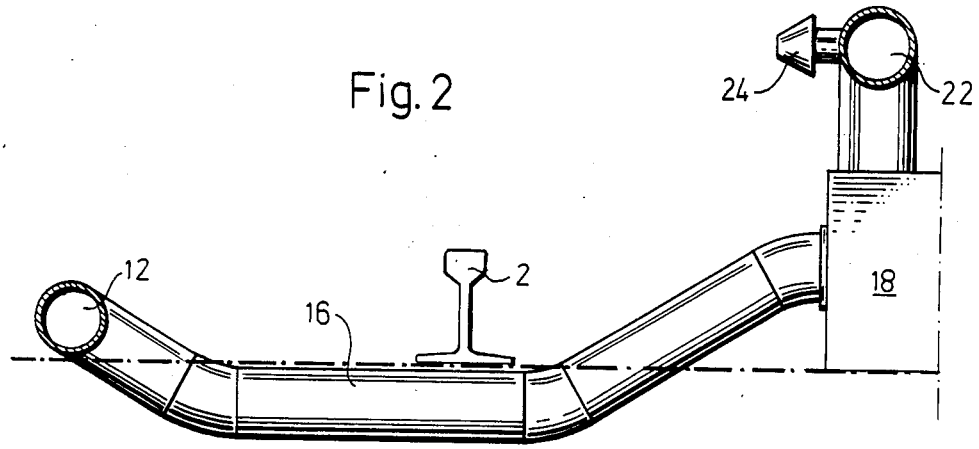
FIG. 2 is a sectional view taken on the line II—II of FIG. 1 illustrating the supply pipe extending from the fan unit under a rail to a distribution pipe, the level of the ballast for the track being shown in broken lines.

In FIG. 2, which is a section according to II—II in FIG. 1, it is more closely illustrated how the supply pipe 16 from the manifold box is taken under the rail 2 to the distribution pipe 12 running parallel to the rail 2. The supply pipe 16 is thus immersed in the track ballast to allow the rail 2 to pass over it.

To one side of the rail 2 there extends the blower arrangement 22, which is also parallel to the rail. Nozzles 24, suitably so-called Dirivent nozzles in which small, high-velocity jets are used to direct a greater flow of air to the location where it is needed, are mounted on the blower arrangement 22 and at right-angles to the rail.

Figure 3:
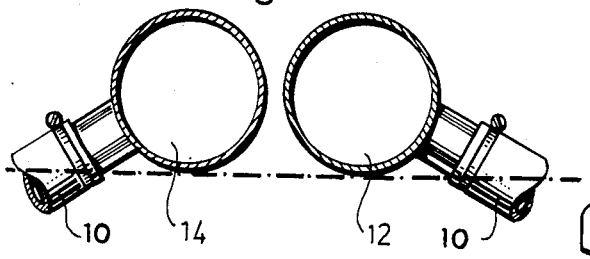
FIG. 3 is a transverse sectional view through the parallel longitudinal distribution pipes showing their hose connections.

The distribution pipes 12, 14, which are connected to the supply pipes 16, are illustrated in cross section in FIG. 3, along with their connections to the hoses 10.

Figure 4:
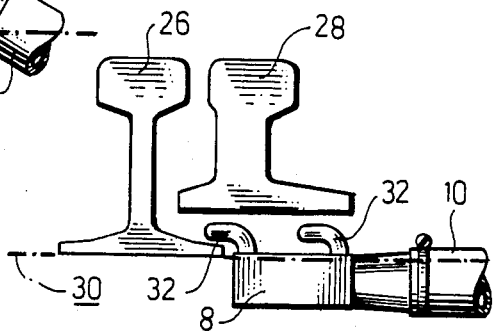
FIG. 4 is a sectional view taken on the line I—I of FIG. 1 illustrating the stock and movable rails of the switch to which the blower unit is applied.

FIG. 4 illustrates a section along the line I—I in FIG. 1 at right-angles to the rail 4, where the stock rail 26 and the movable rail 28 of the switch are shown, together with a blower unit 8. The blower unit 8 is disposed on the inside of the stock rail 26 and buried in the track ballast 30 so that the movable rail 28 can move above the nozzles 32 of the blower unit 8. This unit is connected to the distribution pipe 14 by a hose 10. Since both blower units 8 and distribution pipes 12, 14 are subjected to vibrations when a train passes by, it is essential that the hoses 10 connecting them are flexible.

Figure 5:
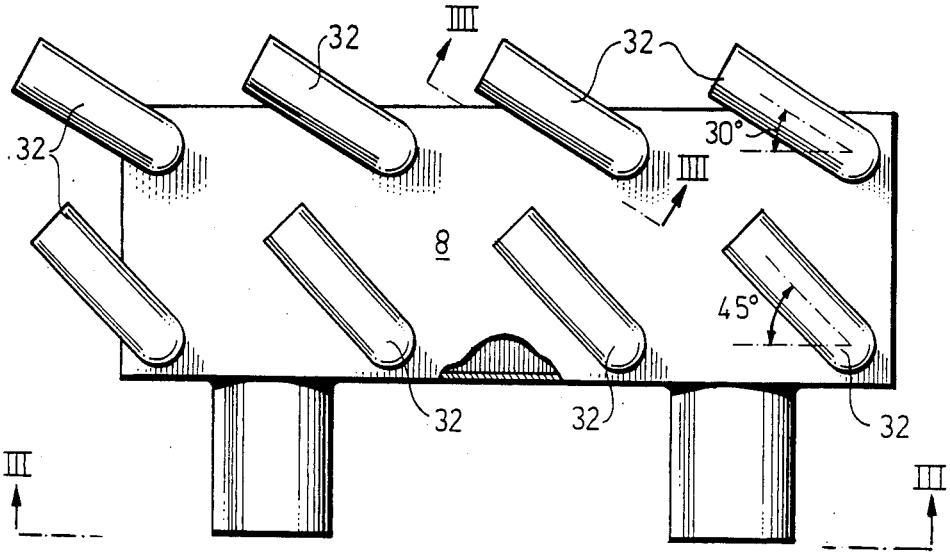
FIG. 5 illustrates an embodiment of the blower unit shown in FIGS. 1 and 4 wherein the unit has a plurality of nozzles arranged on its upper side and two connections for distribution pipes on its inwardly facing side surface.

A blower unit 8 is shown in more detail in a view from above in FIG. 5. On the upper side of the unit 8 there are eight nozzles 32. The nozzles 32 are adapted for substantially horizontal air discharge and are directed at an angle to the inside of the stock rail 26, and outwards towards the open end between the stock rail 26 and the movable rail 28 in their separated positions.

In the embodiment illustrated in FIG. 5 the nozzles 32 are arranged in two rows with four nozzles in each row. The nozzles 32 in the one row are oriented at 30° to the stock rail, while the nozzles 32 in the other row form an angle of 45° to the stock rail and are directed between the nozzles in the first row. In this way it is avoided that the nozzle structures in the first row disturb the air streams from the nozzles in the second row, enabling the latter air streams also to have substantially free passage to the rail. After passing by the nozzle structures, the streams from the second row merge with the streams from the first row in their respective flows toward the free end of the movable rail.

Figure 7:
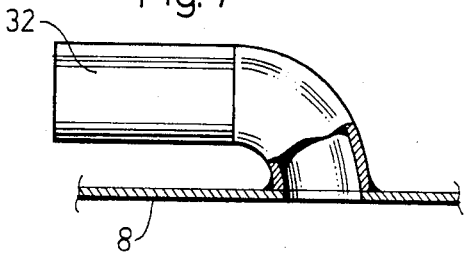
FIG. 7 is a sectional view taken on the line IIII—IIII in FIG. 5 showing an individual nozzle.
Figure 8:
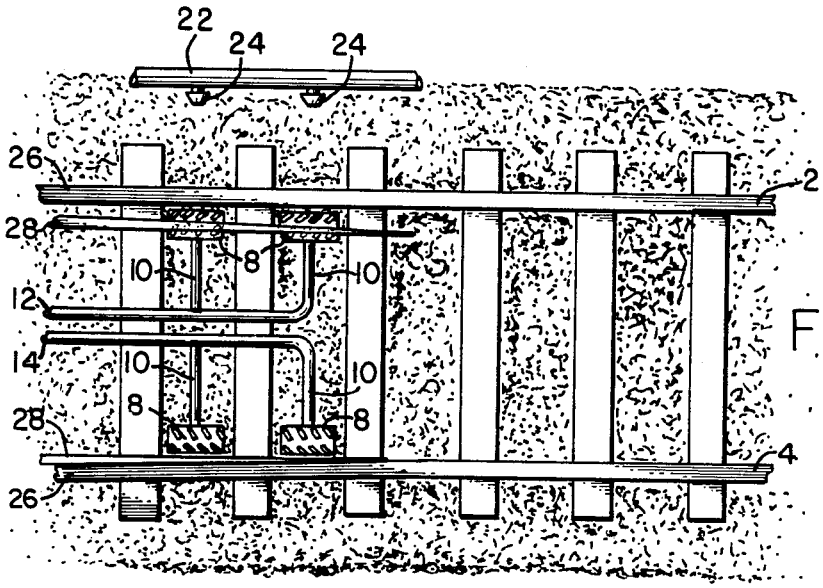
FIG. 8 is an enlarged fragmentary plan view illustrating the arrangement shown in FIG. 4.

FIG. 7 is a section according to IIII—IIII in FIG. 5, illustrating a nozzle 32 in side view.

Figure 6:
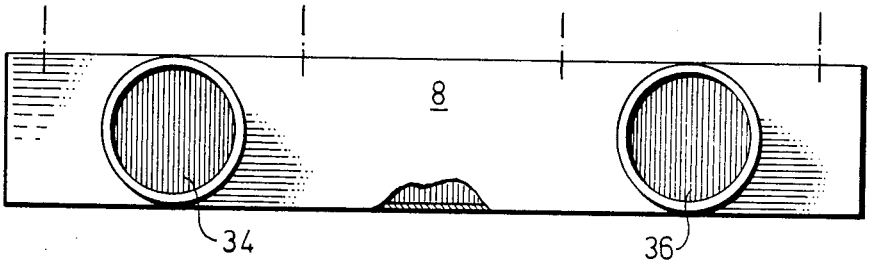
FIG. 6 is a sectional view taken on the line III—III of FIG. 5 with the nozzles removed but indicated in broken lines.

FIG. 6 is a side view according to III—III in FIG. 5 of the blower unit 8, the location of the nozzles 32 being only indicated on the upper side of the unit. In the embodiment illustrated in FIGS. 5 and 6 of the blower unit 8 it is provided with two connections 34, 36 to which flexible hoses 10 are connected for further connection to the distribution pipes 12, 14.

The apparatus functions in the following manner:

The nozzles 32 blow falling snow along the inside of the stock rail 26 and out through the opened end between the stock rail 26 and the movable rail 28 in their separated position. During this process there is a whirling upwards of snow above the rails, which is blown away from the switch area by the air stream directed substantially at right-angles to the track from the nozzles 24 in the laterally situated blower arrangement 22. The switch area is thus not only effectively kept clear from falling snow, but the snow whirled up by a train in its passage is also effectively removed from the switch area.

The apparatus in accordance with the invention is to advantage selectively controllable in different ways. Thus, for a particular switching position, it is an advantage that the manifold box 18 includes air valves operated so that only the blower units 8 on the side of the track where the movable and the stock rail are separated are operated. To this end, as indicated schematically in FIG. 9, the manifold 18 has internal valving (not shown) coupled to the switch actuator 29 to direct the atmospheric air discharged from the fan 20 into whichever of the conduits 12 and 14 is serving the open side of the switch in which the movable rail is spaced from the stock rail, and to restrict the flow of the closed side of the switch in which the movable rail is engaged flush against the stock rail.

Figure 9:
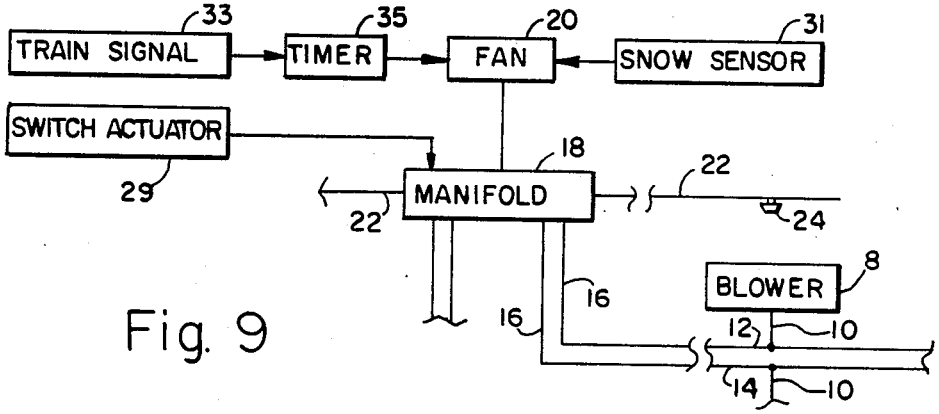
FIG. 9 is a diagram of suitable controls for operating the fan unit.

It is further advantageous if the apparatus is not in continuous operation. A diagrammatic representation of suitable controls is shown in FIG. 9. With this in mind, suitable sensing means 31 are installed in the fan unit 20 to sense a starting snowfall for then starting the fan unit 20 and putting the apparatus into operating mode, as well as stopping the apparatus into rest mode when the snowfall ceases. Alternatively, the fan unit 20 in the rest mode can normally operate at a low basic rotation speed which is automatically increased to a considerably higher working rotation speed in the operating mode when a starting snowfall has been sensed, the apparatus then returning to the basic rotation speed when the snowfall ceases. In a similar way, signal means are to advantage provided in association with the unit 20 for increasing the fan rotation speed from basic to working speed when a train signal 33 indicates that a train approaches, or during its passage, and then lowering the speed to the basic speed again after the train has passed, and preferably with a given time lapse due to a timer 35. By the apparatus thus only being operated in its operating mode during snowfall and/or train passage, wear on the apparatus is reduced and energy is saved.

The distribution pipes 12, 14 extending along the track between the rails rest on the substructure. These pipes can thus be an obstacle, particularly in marshalling yards, where the marshalling personnel can stumble against them so that accidents occur. To eliminate this disadvantage, the distribution pipes can be covered over by a flat floor structure between the rails when the apparatus is installed in places where personnel is likely to move about in the neighbourhood of the rails.

I claim:

1. Apparatus for preventing snow from bedding into a railway switch having a pair of stock rails and a pair of movable rails mounted on sleepers in a switch area, each movable rail having a free end displaceable between an open position and closed position relative to the adjacent stock rail, the free end of one of said pair of movable rails being open and separated from its adjacent stock rail when the free end of the other movable rail is closed against the adjacent stock rail, comprising between the stock rails a blower assembly including a plurality of blower units arranged in the switch area under the movable rails, each blower unit being arranged between two adjacent sleepers, each said unit being provided on its upper side with discharge nozzles arranged in two rows generally parallel to the stock rail directing air substantially horizontally towards the space between the free end of the movable rail and the adjacent stock rail created when in their separated positions, each of said nozzles producing a substantially horizontal air stream directed obliquely outwards towards said free end, and a fan unit to supply said assembly with cold atmospheric air.

2. Apparatus as claimed in claim 1, wherein selected nozzles are disposed to discharge at different directions from each other toward the rails.

3. Apparatus as claimed in claim 1, wherein each blower unit has eight discharge nozzles.

4. Apparatus as claimed in claim 1, wherein the discharge direction of the nozzles in each of the rows form acute angles to the longitudinal direction of the rail, the angles of the nozzles in one row being different from the angles of the nozzles in the other row.

5. Apparatus as claimed in claim 4, wherein said nozzles in the one row are at an angle of 30° to the rail and the nozzles of the other row are at an angle of 45° to the rail, and the flows of air from the nozzles in a first of said rows is directed between the nozzles in the second of said rows.

6. Apparatus as claimed in claim 1, wherein said supply fan unit is connected to said blower units by at least one distribution pipe disposed between, and parallel to, the rails.

7. Apparatus as claimed in claim 1, said apparatus having a rest mode and an operating mode, and including snow sensing means to put the apparatus into its operating mode and to put the apparatus in rest mode, when a snowfall starts and stops, respectively.

8. Apparatus according to claim 7 wherein said fan is stoppped in said rest mode.

9. Apparatus as claimed in claim 1, including signal means connected to said fan to change the rotation speed of the fan between a rest mode and an operating mode and to put the apparatus in operating mode upon the passage of a train into the switch, and to once again lower the rotation speed of the fan to the rest mode with a given time delay after the train has passed the switch.

* * * * *